US012747069B2

(12) United States Patent
Chen et al.

(10) Patent No.: US 12,747,069 B2
(45) Date of Patent: Sep. 29, 2026

(54) CONTAINER ASSEMBLY AND COVER AND CONTAINER THEREOF

(71) Applicant: Yulan Green Technology Co., Ltd., Yilan County (TW)

(72) Inventors: Chun-Hsiung Chen, Yilan County (TW); Kao-Yi Chang, Yilan County (TW)

(73) Assignee: Yulan Green Technology Co., Ltd., Yilan County (TW)

( * ) Notice: Subject to any disclaimer, the term of this patent is extended or adjusted under 35 U.S.C. 154(b) by 0 days.

(21) Appl. No.: 18/644,548

(22) Filed: Apr. 24, 2024

(65) Prior Publication Data

US 2024/0359876 A1 Oct. 31, 2024

(30) Foreign Application Priority Data

Apr. 25, 2023 (TW) ..... 112115376

(51) Int. Cl.
*B65D 43/02* (2006.01)
*B65D 3/06* (2006.01)

(52) U.S. Cl.
CPC ..... *B65D 43/0212* (2013.01); *B65D 3/06* (2013.01); *B65D 2251/20* (2013.01)

(58) Field of Classification Search
CPC . B65D 41/06; B65D 43/0212; B65D 2251/20
USPC ..... 220/784; 215/337
See application file for complete search history.

(56) References Cited

U.S. PATENT DOCUMENTS 1,495,323 A * 5/1924 Hammer ..... B65D 41/04 215/337
8,870,015 B1 * 10/2014 LaMasney ..... B65D 45/18 220/802

FOREIGN PATENT DOCUMENTS

| | | |
|---|---|---|
| CN | 108420262 A | 8/2018 |
| TW | 201116456 A | 5/2011 |
| TW | I610007 B | 1/2018 |

OTHER PUBLICATIONS

Search Report appended to an Office Action, which was issued to Taiwanese counterpart application No. 112115376 by the TIPO on Jan. 2, 2024, with an English translation thereof.

* cited by examiner

*Primary Examiner* — Jeffrey R Allen
(74) *Attorney, Agent, or Firm* — Muncy, Geissler, Olds & Lowe, P.C.

(57) ABSTRACT

A cover of a container assembly includes a cover portion, a connecting portion connected to a periphery of the cover portion, and a plurality of stopping protrusions formed around the outer sidewall. The cover is detachably connected to a mouth portion of a container of the container assembly, and cooperates with the container to define a receiving space. The connecting portion includes an outer sidewall surrounding and pressing against the mouth portion and having an end edge. Each stopping protrusion forms an included angle with the end edge, and has a highest point cooperating with a lowest point of the mouth portion to define a contact area having a height along the axis that is more than 30% of a height of each stopping protrusion along the axis.

11 Claims, 9 Drawing Sheets

CONTAINER ASSEMBLY AND COVER AND CONTAINER THEREOF

CROSS-REFERENCE TO RELATED APPLICATION

This application claims priority to Taiwanese Invention Patent Application No. 112115376, filed on Apr. 25, 2023, and incorporated by reference herein in its entirety.

FIELD

The disclosure relates to a container assembly for containing liquid, and a cover and a container thereof.

BACKGROUND

Referring to FIG. 1, a paper molded cup lid 1, as disclosed in Taiwanese Patent No. 1610007B, includes a central portion 11, an edge portion 12 connected to a periphery of the central portion 11, and an engaging portion 13. The edge portion 12 has two sidewalls 121, and a top end wall 122 connected between the sidewalls 121. The engaging portion 13 is formed on an inner surface of an outermost one of the sidewalls 121.

When the cup lid 1 is engaged with a top end of a container 2, the engaging portion 13 thereof surrounds the top end of the container 2, and abuts against a lower edge of a protrusion 21 that is connected to the top end of the container 2. Through this, the cup lid 1 can be firmly connected to the container 2.

The engaging portion 13 and the protrusion 21 abut against each other in an upward and downward positional relationship. Although the engaging portion 13 and the protrusion 21 can block each other to prevent the cup lid 1 or the container 2 from falling apart, when the lateral friction force is weak, the cup lid 1 and the container 2 can easily rotate relative to each other. Moreover, when a gap is formed among the top end wall 122, an innermost one of the sidewalls 121 and the protrusion 21, the sealing effect between the paper molded cup lid 1 and the container 2 is poor.

SUMMARY

Therefore, an object of the present disclosure is to provide a container assembly that can alleviate at least one of the drawbacks of the prior art and a cover and a container thereof.

According to one aspect of this disclosure, the cover of the container assembly includes a cover portion, a connecting portion, and a plurality of stopping protrusions. The container assembly further includes a container having a mouth portion surrounding an axis. The cover is configured to be detachably connected to the mouth portion of the container, and is configured to cooperate with the container to define a receiving space. The connecting portion is connected to a periphery of the cover portion, and includes an outer sidewall that is configured to surround and press against the mouth portion and that has an end edge. The stopping protrusions are formed around the outer sidewall. Each stopping protrusion forms an included angle with the end edge, and defines a gap with an adjacent one of the stopping protrusions. Each stopping protrusion has a highest point configured to cooperate with a lowest point of the mouth portion to define a contact area for frictional contact with the mouth portion. The contact area has a height along the axis that is more than 30% of a height of each stopping protrusion along the axis.

According to another aspect of this disclosure, the container assembly includes a plurality of containers each including a mouth portion surrounding an axis, and a plurality of the aforesaid covers each of which is detachably connected to the mouth portion of a respective one of the containers and each of which cooperates with the respective one of the containers to define a receiving space.

The connecting portion of each cover further includes an inner sidewall surrounded by and radially spaced apart from the outer sidewall, and an abutment end wall connected between the inner and outer sidewalls and having a position difference with the cover portion along the axis. The inner and outer sidewalls of each cover are configured to press against and clamp therebetween the mouth portion of the respective container. The abutment end wall and the inner and outer sidewalls of each cover cooperatively define an accommodating space for receiving the mouth portion of the respective container and having an opening opposite to the abutment end wall.

The covers are stackable along the axis. When the covers are stacked, the abutment end wall of one of the covers abuts against the stopping protrusions of an adjacent one of the covers, and the cover portion, the abutment end wall and the inner sidewall of each cover are respectively spaced apart from the cover portion, the abutment end wall and the inner sidewall of an adjacent cover.

According to yet another of this disclosure, the container assembly includes a container having a mouth portion surrounding an axis, and the aforesaid cover detachably connected to the mouth portion of the container and cooperating with the container to define a receiving space.

BRIEF DESCRIPTION OF THE DRAWINGS

Other features and advantages of the disclosure will become apparent in the following detailed description of the embodiment with reference to the accompanying drawings. It is noted that various features may not be drawn to scale.

DETAILED DESCRIPTION

Figure 1:
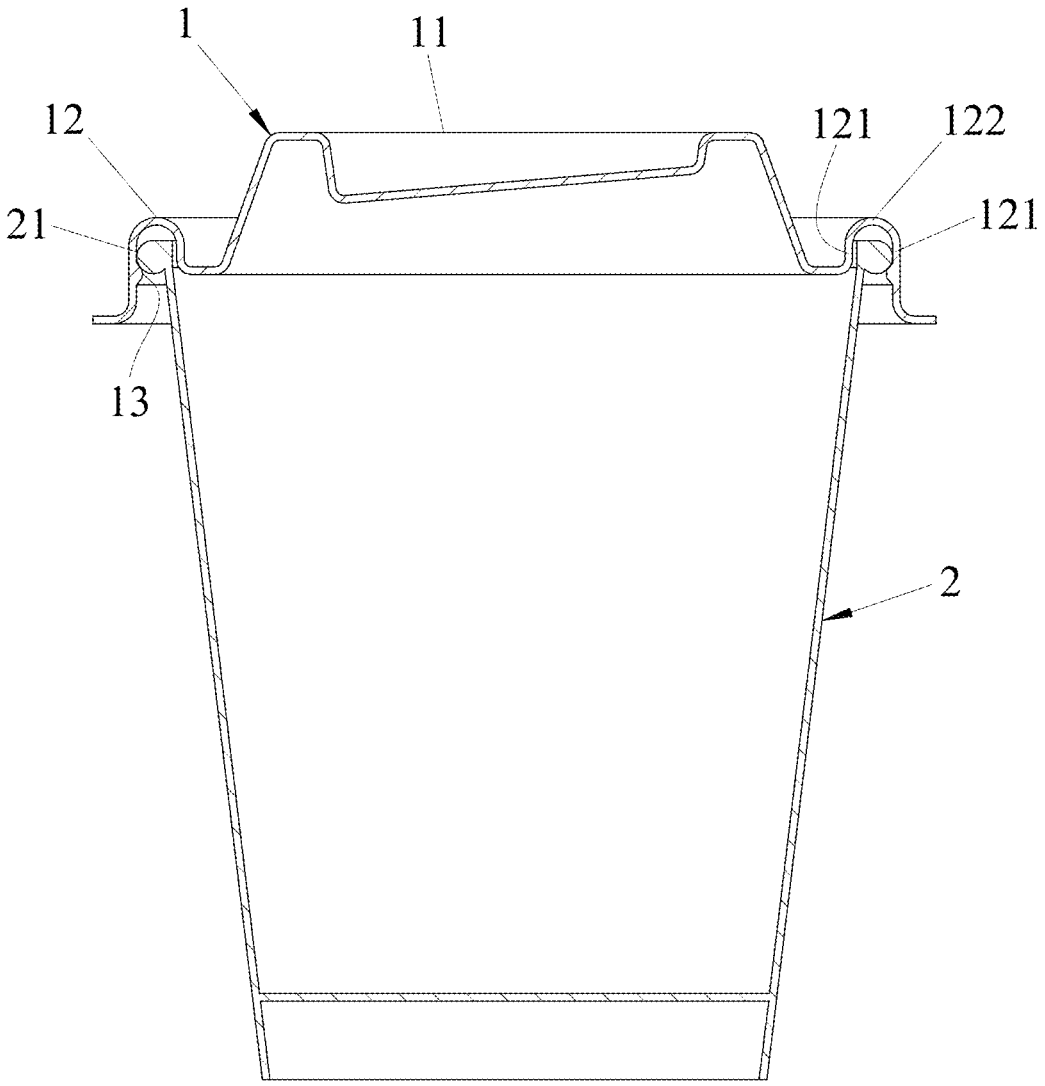
FIG. 1 PRIOR ART
FIG. 1 is a sectional view of a paper molded cup lid disclosed in Taiwanese Patent No. 1610007B engaged to a container.
Figure 2:
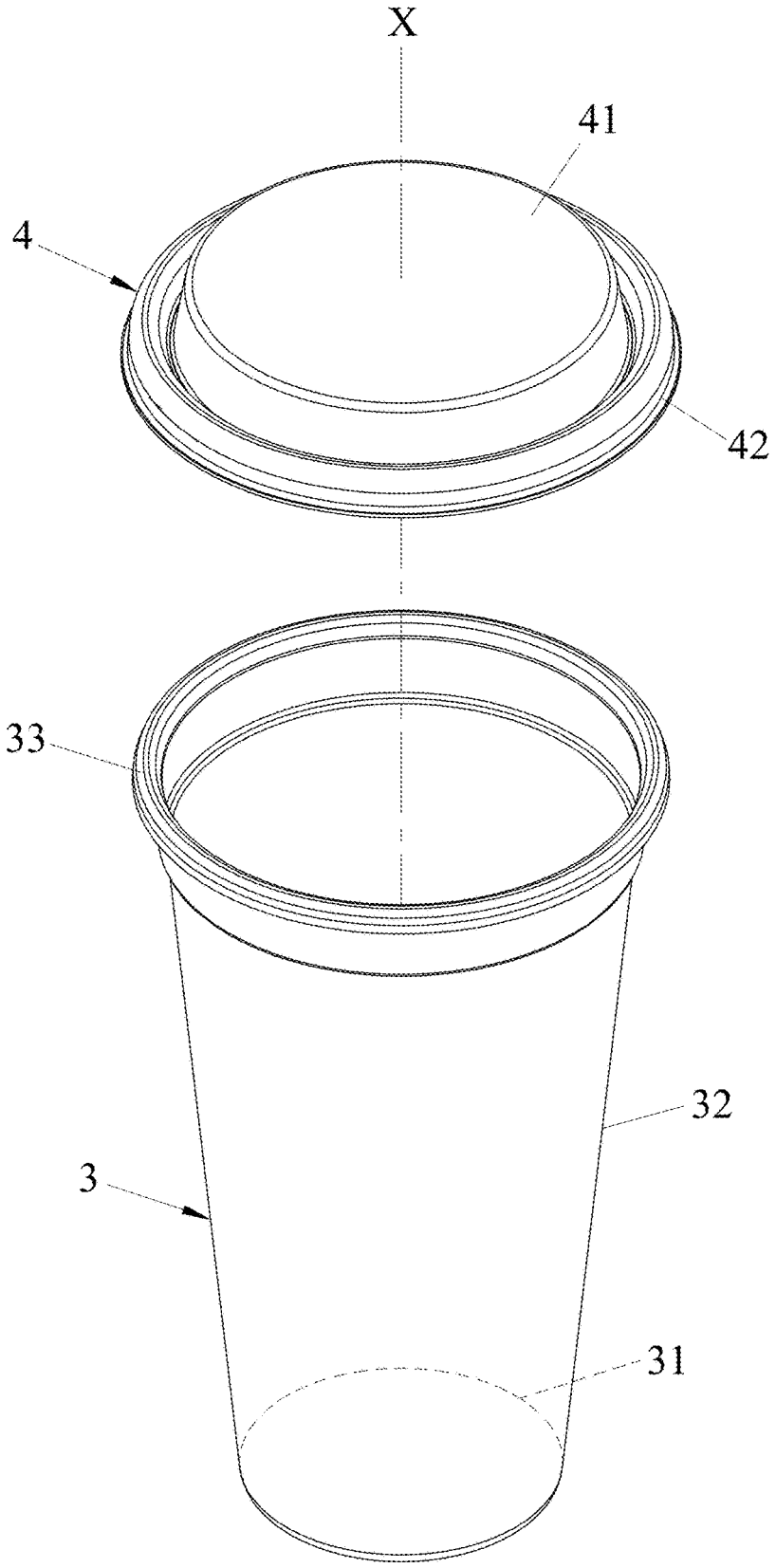
FIG. 2 is an exploded perspective view of a container and a cover of a container assembly according to an embodiment of the present disclosure.
Figure 3:
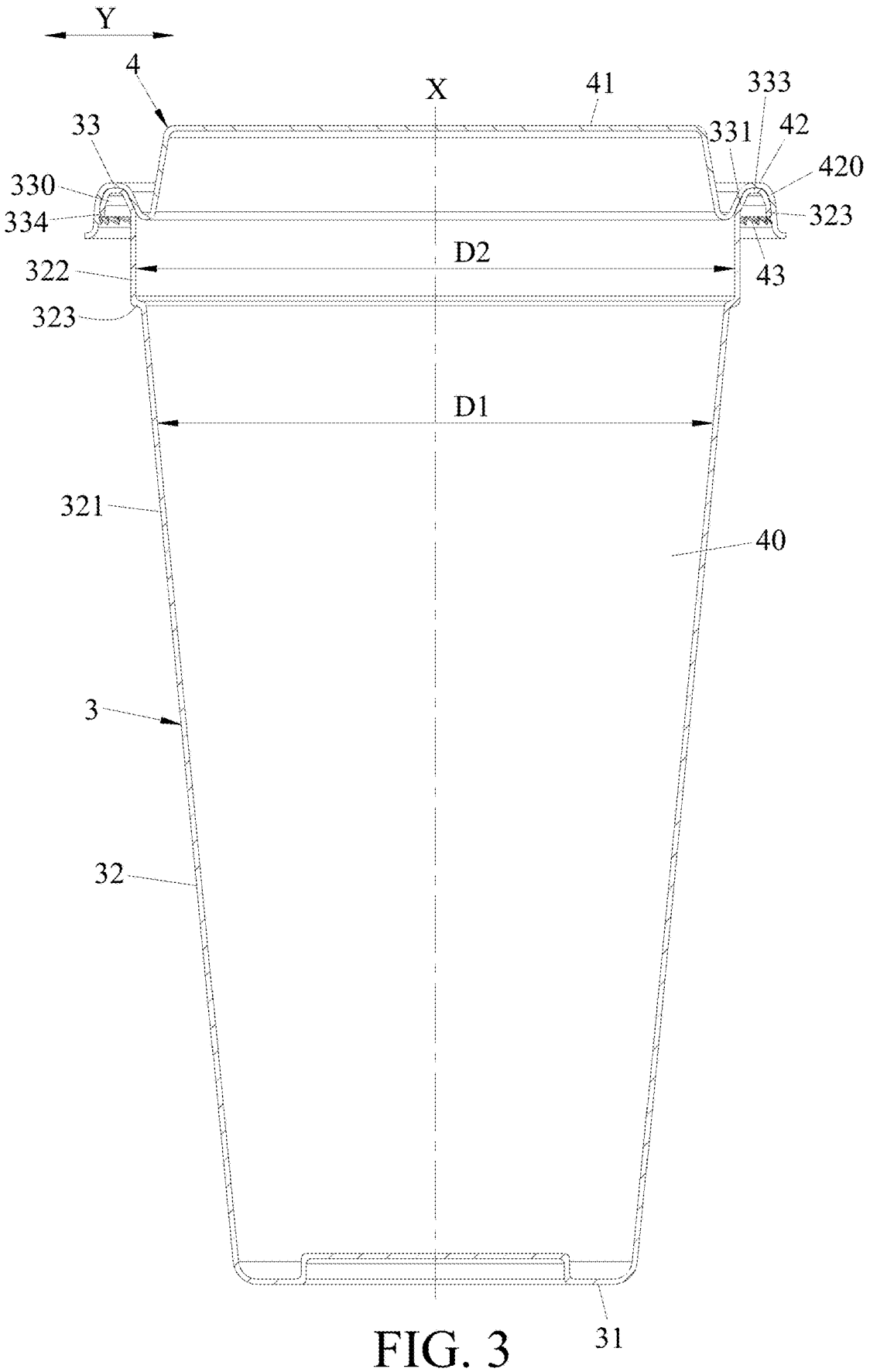
FIG. 3 is an assembled sectional view of the embodiment.

Referring to FIGS. 2 and 3, a container assembly according to an embodiment of the present disclosure includes a container 3 and a cover 4.

In this embodiment, the container 3 is a cup, and includes a bottom wall 31, a surrounding wall 32 extending upwardly from a periphery of the bottom wall 31 along an axis (X), and a mouth portion 33. The bottom wall 31, the surrounding wall 32 and the mouth portion 33 are integrally formed as one piece from pulp.

The surrounding wall 32 has a first or small diameter section 321 connected to the bottom wall 31, a second or large diameter section 322 opposite to the small diameter section 321, and an abutment section 323 connected between the small and large diameter sections 321, 322. The small diameter section 321 has a width (D1) along a width direction (Y) transverse to the axis (X) less than a width (D2) of the large diameter section 322 along the width direction (Y).

The mouth portion 33 surrounds the axis (X), and includes an inner annular wall 331 connected to an end of the large diameter section 322 that is opposite to the bottom wall 31, an outer annular wall 332 radially spaced apart from the inner annular wall 331, and a top end wall 333 interconnecting the inner and outer annular walls 331, 332 and having a position difference with the bottom wall 31 along the axis (X). The top end wall 333 and the inner and outer annular walls 331, 332 cooperatively define an annular space 330 having an opening opposite to the top end wall 333. The outer annular wall 332 has a lowest point 334.

Figure 4:
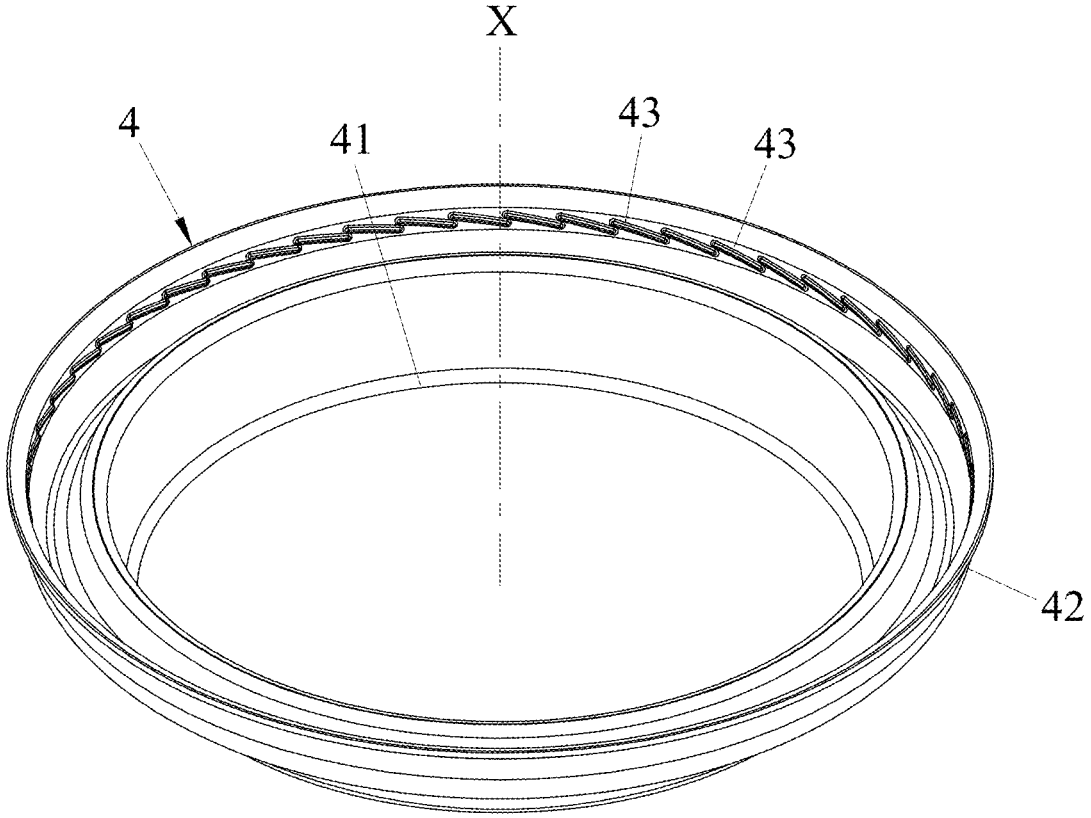
FIG. 4 is a perspective view of the cover of the embodiment.
Figure 5:
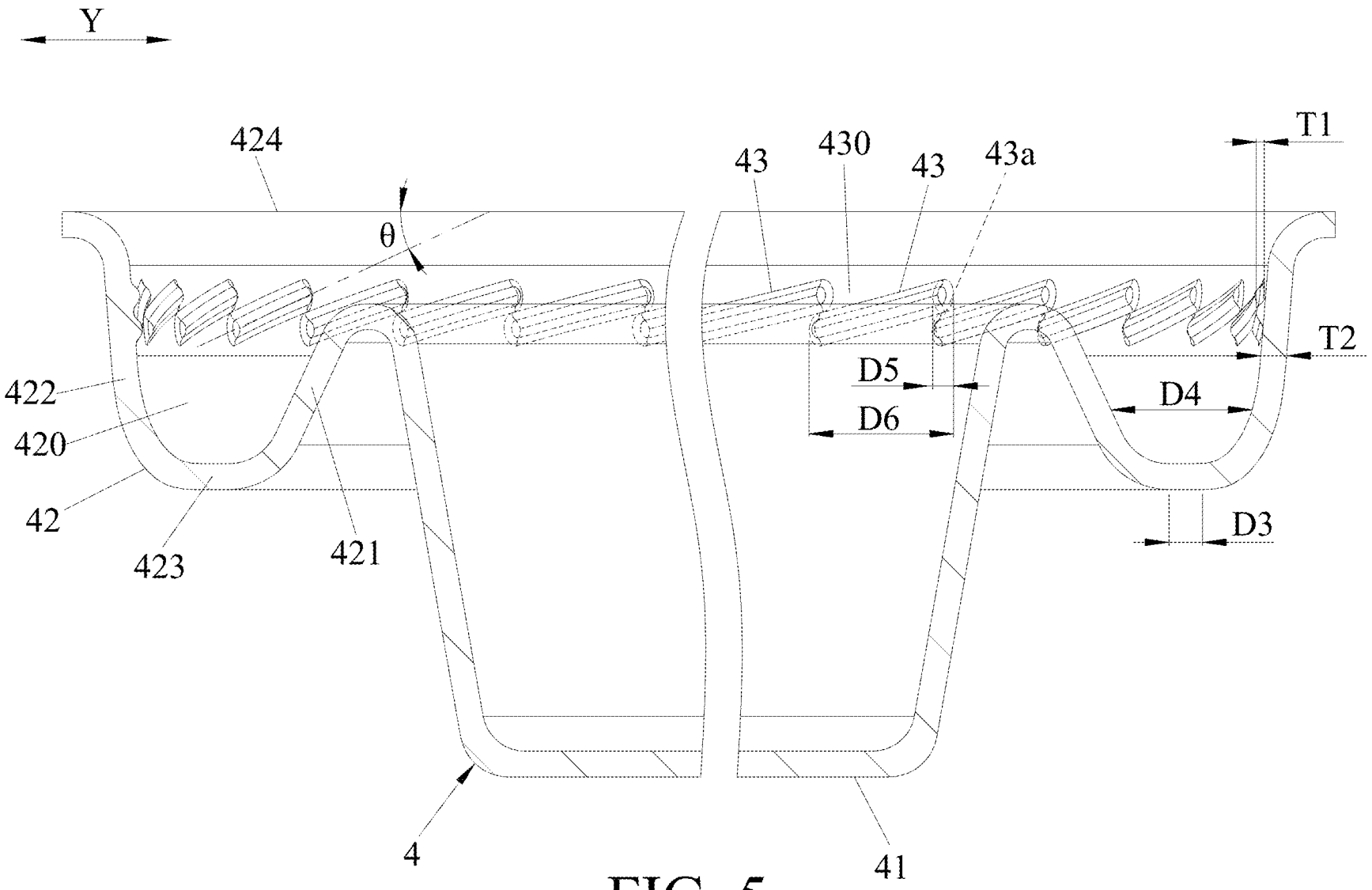
FIG. 5 is a fragmentary sectional view of the cover of the embodiment.

Referring to FIGS. 4 and 5, in combination with FIG. 3, the cover 4 is detachably connected to the mouth portion 33 of the container 3, and cooperates with the container 3 to define a closed receiving space 40. The receiving space 40 is adapted to receive liquid. The cover 4 includes a central cover portion 41, a connecting portion 42 connected to a periphery of the cover portion 41, and a plurality of stopping protrusions 43. The cover portion 41, the connecting portion 42, and the stopping protrusions 43 are integrally formed as one piece from pulp.

The connecting portion 42 includes an inner sidewall 421 connected to the periphery of the cover portion 41, an outer sidewall 422 radially spaced apart from and surrounding the inner sidewall 421, and an abutment end wall 423 connected between the inner and outer sidewalls 421, 422 and having a position difference with the cover portion 41 along the axis (X). The outer sidewall 422 has an end edge 424 opposite to the abutment end wall 423. The abutment end wall 423 and the inner and outer sidewalls 421, 422 cooperatively define an accommodating space 420 having an opening opposite to the abutment end wall 423. The abutment end wall 423 has a width (D3) along the width direction (Y) less than a width (D4) of the accommodating space 420 along the width direction (Y).

The stopping protrusions 43 are formed around an inner surface of the outer sidewall 422. Each stopping protrusion 43 extends inclinedly relative to the width direction (Y), and forms an included angle (θ) with the end edge 424. The included angle (θ) ranges from 15 to 45 degrees, preferably, 25 degrees. Each stopping protrusion 43 has a highest point 431, and defines a gap 430 with an adjacent one of the stopping protrusions 43. Each stopping protrusion 43 further defines an overlapping area (43*a*) with the adjacent stopping protrusion 43. The overlapping area (43*a*) has a width (D5) along the width direction (Y) that is 10% to 60% of a width (D6) of each stopping protrusion 43 along the width direction (Y).

A ratio of a thickness (T1) of each stopping protrusion 43 protruding from the outer sidewall 422 and a thickness (T2) of the outer sidewall 422 along the width direction (Y) ranges from 1:1 to 1:4, preferably, 1:2 to 1:3. In this embodiment, the number of the stopping protrusions 43 ranges from 20 to 120, preferably, 40 to 120. The width (D6) of each stopping protrusion 43 ranges from 5 mm to 20 mm, and the thickness (T1) thereof ranges from 0.2 mm to 1.2 mm, preferably, 0.3 mm to 0.6 mm.

Figure 6:
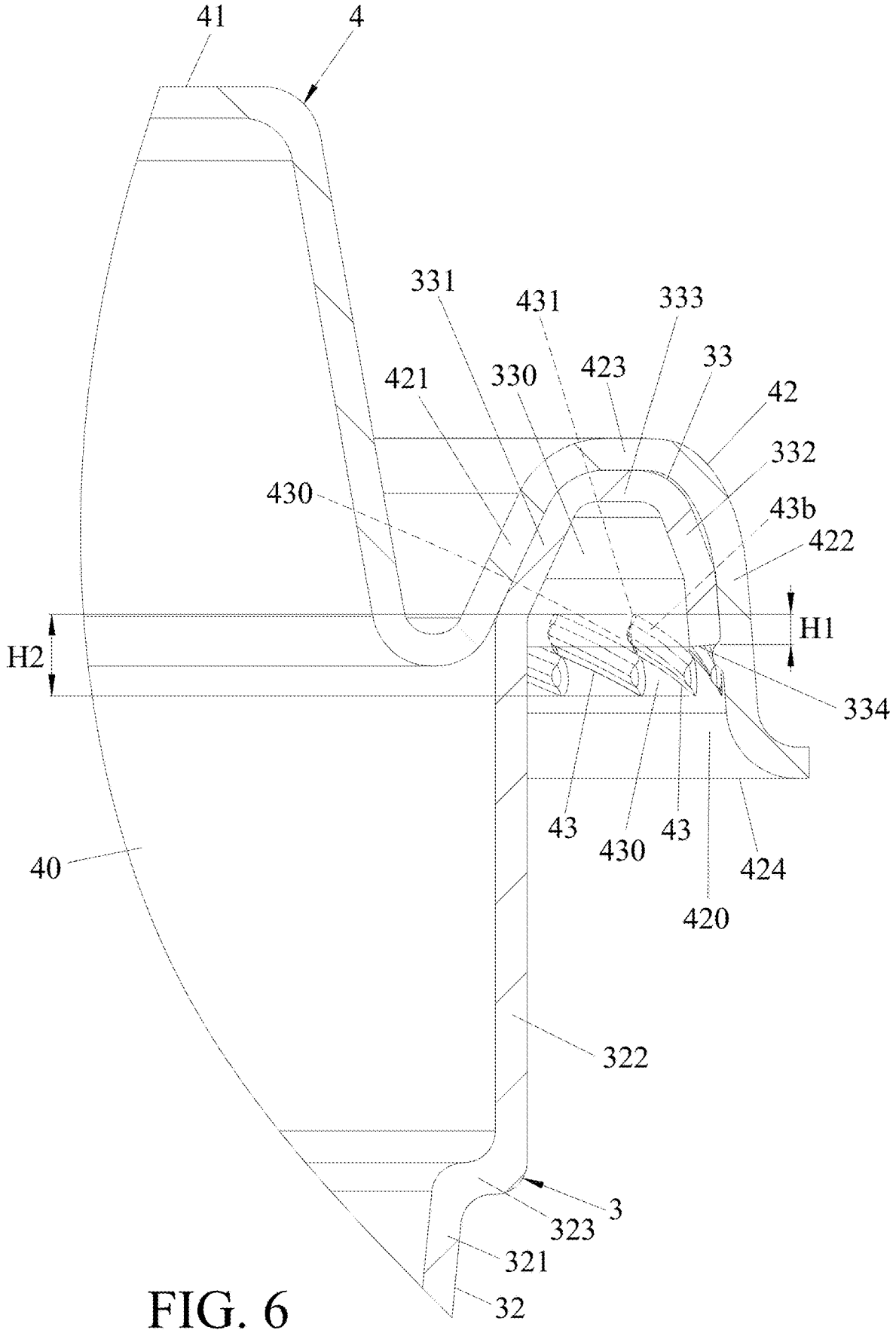
FIG. 6 is an enlarged fragmentary sectional view of a portion of FIG. 3.

Referring to FIG. 6, in combination with FIGS. 3 and 5, when the cover 4 is moved toward the container 3 along the axis (X) and is sleeved on the mouth portion 33 thereof, the mouth portion 33 is inserted into the accommodating space 420 until it presses against the abutment end wall 423 of the cover 4. At this time, the accommodating space 420 of the cover 4 receives the mouth portion 33 of the container 33, and the inner and outer sidewalls 421, 422 of the cover 4 respectively press against and clamp therebetween the inner and outer annular walls 331, 332 of the mouth portion 33 of the container 3, and the abutment end wall 423 of the cover 4 presses against the top end wall 333 of the mouth portion 33.

Hence, with the inner sidewall 421 of the cover 4 and the inner annular wall 331 of the mouth portion 33 abutting against and in frictional contact with each other, with the outer sidewall 422 of the cover 4 and the outer annular wall 332 of the mouth portion 33 abutting against and in frictional contact with each other, and with the abutment end wall 423 of the cover 4 and the top end wall 333 of the mouth portion 33 abutting against and in frictional contact with each other, they can form three tight rings from the inside to the outside after the cover 4 is engaged to the container 3.

More importantly, since the container 3 and the cover 4 are made of pulp, they have elastoplasticity. Therefore, during pressing of the outer sidewall 422 of the cover 4 against the outer annular wall 332 of the mouth portion 33, apart from the outer annular wall 332 being able to deform in the annular space 330 so as to get close to the outer sidewall 422, the stopping protrusions 43 between the outer sidewall 422 and the outer annular wall 332 can also press against the outer annular wall 332.

At this time, the highest point 431 of each stopping protrusion 43 can cooperate with the lowest point 334 of the mouth portion 33 to define a contact area (43*b*) for frictional contact with the mouth portion 33. Furthermore, a portion of the outer annular wall 332 falls into the gaps 430 formed between adjacent ones of the stopping protrusions 43, and is in frictional contact with the contact area (43*b*). The contact area (43*b*) has a height (H1) along the axis (X) that is more than 30% of a height (H2) of each stopping protrusion 43 along the axis (X), and a size that is proportional to the friction force between each stopping protrusion 43 and the mouth portion 33.

In addition to significantly expanding the frictional contact area between the cover 4 and the mouth portion 33 so as to increase the stability of the connection of the cover 4 with the mouth portion 33, the tight rings can also be used to form protective layers with different blocking directions from the inside to the outside to prevent the liquid in the receiving space 40 from leaking outwardly. More importantly, when the portion of the outer annular wall 332 falls into the gaps 430, the stopping protrusions 43 can engage the outer annular wall 332 to prevent the container 3 and the cover 4 from rotating relative to each other.

Since the container 3 and the cover 4 are made of pulp, the outer sidewall 422, the stopping protrusions 43, and the outer annular wall 332 are deformable. Hence, when an external force is sufficient to deform the stopping protrusions 43 or the outer annular wall 332, the container 3 and the cover 4 can rotate slightly.

Figure 7:
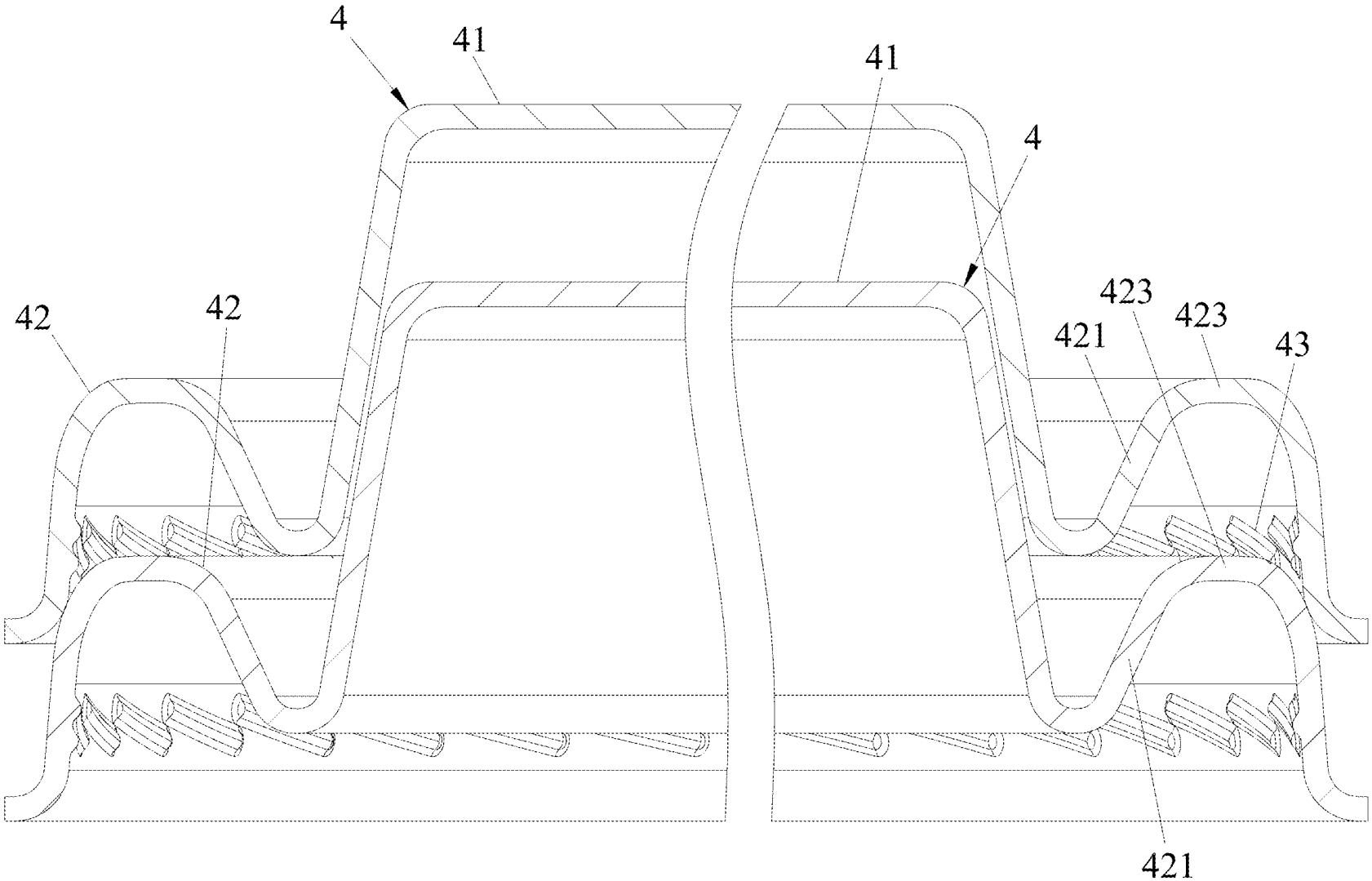
FIG. 7 is a fragmentary sectional view, illustrating a plurality of the covers of the embodiment stacked on top of each other.

Referring to FIG. 7, before a plurality of the covers 4 are connected to a plurality of the containers 3, respectively, the covers 4 can be stacked on top of each other along the axis (X). When the covers 4 are stacked, the abutment end wall 423 of one of the covers 4 abuts against the stopping protrusions 43 of an adjacent one of the covers 4, and the cover portion 41, the abutment end wall 423 and the inner sidewall 421 of each cover 4 are respectively spaced apart from the cover portion 41, the abutment end wall 423 and the inner sidewall 421 of the adjacent cover 4. In this manner, not only the space occupied by the covers 4 can be reduced to promote space efficiency, but also the contact area of adjacent covers 4 can be reduced to prevent the adjacent covers 4 from squeezing against each other, thereby facilitating easy access to an outermost cover 4.

Figure 8:
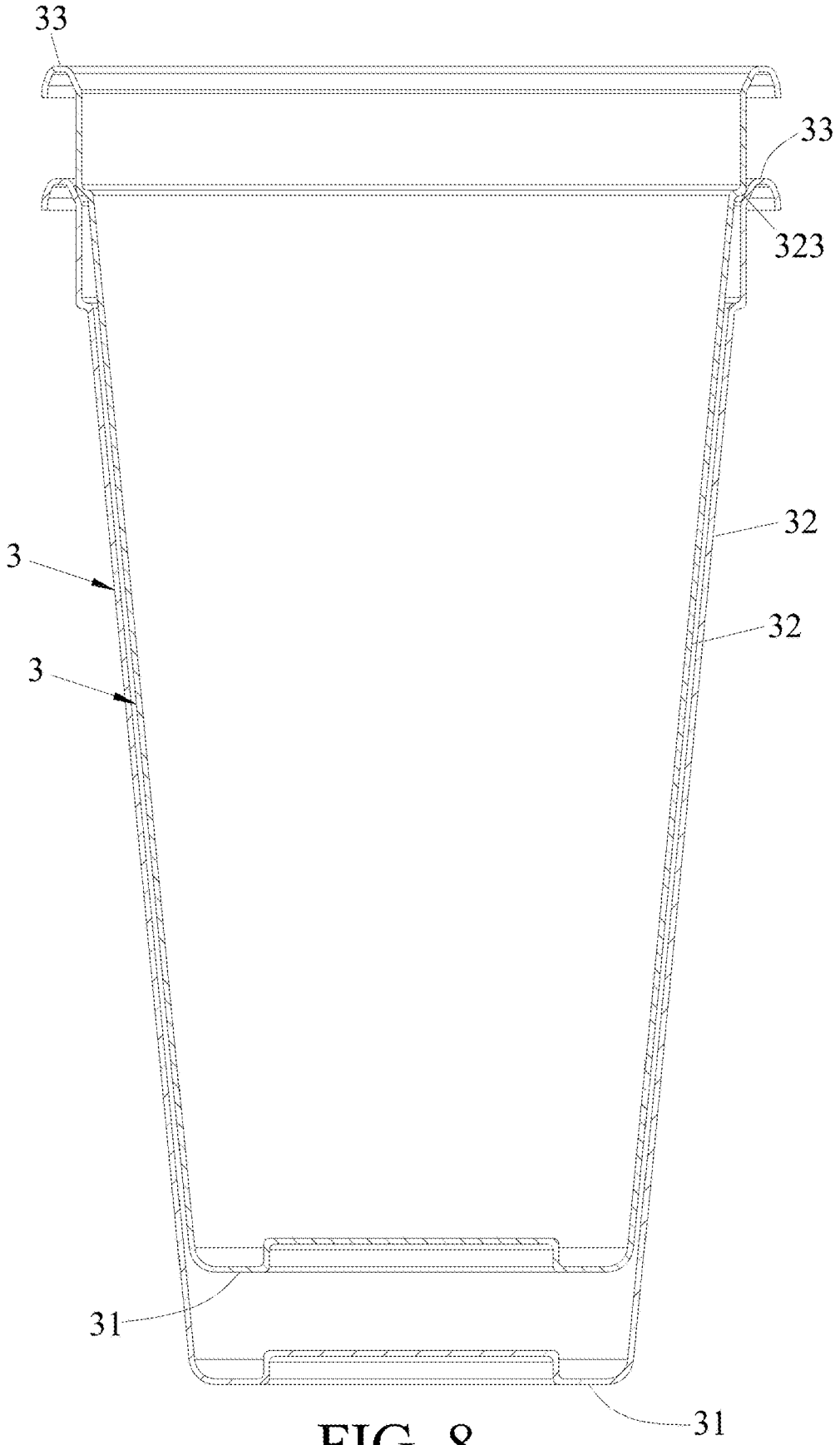
FIG. 8 is a sectional view, illustrating a plurality of the containers of the embodiment stacked on top of each other.

Referring to FIG. 8, in combination with FIG. 3, similarly, before the containers 3 are connected to the respective covers 4, they can also be stacked on top of each other along the axis (X). When the containers 3 are stacked, the mouth portion 33 of one of the containers 3 abuts against the abutment section 323 of an adjacent one of the containers 3, and the bottom and surrounding walls 31, 32 of each container 3 are respectively spaced apart from the bottom and surrounding walls 31, 32 of the adjacent container 3. In this manner, the space occupied by the containers 3 can be reduced to promote the space efficiency, and the contact area of the adjacent containers 3 can also be reduced to prevent the adjacent containers 3 from squeezing against each other, thereby facilitating easy access to an outermost container 3.

Figure 9:
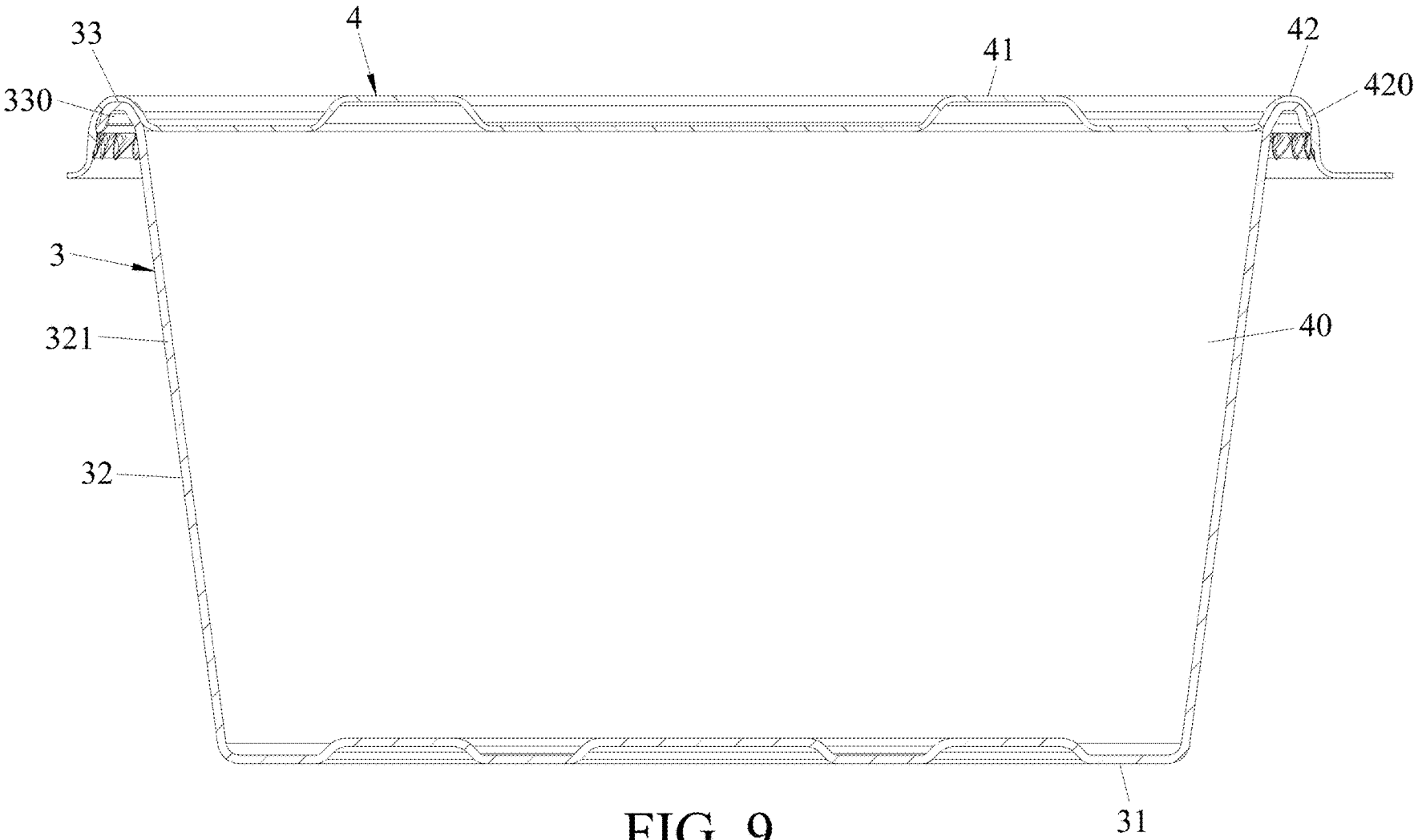
FIG. 9 is a view similar to FIG. 3, but with the container and the cover in different forms.

It should be noted that the container 3 is not limited to a cup, and in other variations of this embodiment, the container 3 may be a bowl, as shown in FIG. 9, or other types of container. Since those with ordinary knowledge in the art can deduce the extended details based on the above description, no further description will be given herein.

Through the above description, the advantages of this disclosure can be summarized as follows:

1. With the inner sidewall 421, the outer sidewall 422, and the abutment end wall 423 of the cover 4 being capable of abutting against and frictionally contacting the inner annular wall 331, the outer annular wall 332, and the top end wall 333 of the mouth portion 33 of the container 3, respectively, this disclosure is formed with three tight rings with different blocking directions from the inside to the outside. Through this, liquid in the receiving space 40 can be effectively prevented from leaking outwardly so as to enhance the overall sealing effect of this disclosure.

2. The stopping protrusions 43 surround and frictionally contact the outer annular wall 332 of the mouth portion 33, in addition to significantly increasing the frictional contact area of the outer sidewall 422 with the outer annular wall 332 so as to increase the lateral friction force and enhance the bonding force and stability of the cover 4 with the container 3, more importantly, when the portion of the outer annular wall 332 falls into the gaps 430, the stopping protrusions 43 can engage with the outer annular wall 332 of the mouth portion 33 to prevent the container 3 and the cover 4 from rotating relative to each other.

3. Through the design of the abutment end wall 423 and the stopping protrusions 43 of the cover 4, when the plurality of the covers 4 are stacked, the cover portion 41, the abutment end wall 423, and the inner sidewall 421 of each cover 4 can be spaced apart from the cover portion 41, the abutment end wall 423, and the inner sidewall 421 of the adjacent cover 4, respectively, thereby reducing the contact area of the adjacent covers 4 and preventing the adjacent covers 4 from squeezing against each other to facilitate easy access to the outermost cover 4.

4. Through the design of the abutment section 323 of the surrounding wall 32 of the container 3, when the plurality of the containers 3 are stacked, the bottom wall 31 and the surrounding wall 32 of each container 3 can be spaced apart from the bottom wall 31 and the surrounding wall 32 of the adjacent container 3, respectively, thereby reducing the contact area of the adjacent containers 3 and preventing the adjacent containers 3 from squeezing against each other to facilitate easy access of the outermost container 3.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A cover of a container assembly, the container assembly further including a container having a mouth portion surrounding an axis, said cover being configured to be detachably connected to the mouth portion of the container and being configured to cooperate with the container to define a receiving space, said cover comprising:

a cover portion;

a connecting portion connected to a periphery of said cover portion and including an outer sidewall that is configured to surround and press against the mouth portion and that has an end edge; and a plurality of stopping protrusions formed around said outer sidewall, each of said stopping protrusions forming an included angle with said end edge and defining a gap with an adjacent one of said stopping protrusions, each of said stopping protrusions having a highest point and a lowest point opposite to each other along the axis, the highest point of each of said stopping protrusions being configured to cooperate with a lowest point of the mouth portion to define a contact area for frictional contact with the mouth portion, said contact area having a height from the lowest point of the mouth portion to the highest point of each of said stopping protrusions along the axis that is more than 30% of a height from the lowest point of each of said stopping protrusions to the highest point of each of said stopping protrusions along the axis;

wherein each of said stopping protrusions extends relative to a width direction transverse to the axis, and further defines an overlapping area with said adjacent one of said stopping protrusion, such that there are a plurality of overlapping areas, each of said overlapping areas having a width along the width direction that is 10% to 60% of a width of each of said stopping protrusions along the width direction.

2. The cover as claimed in claim 1, wherein said included angle ranges from 15 degrees to 45 degrees.

3. The cover as claimed in claim 1, wherein a ratio of a thickness of each of said stopping protrusions protruding from said outer sidewall and a thickness of said outer sidewall along a width direction transverse to the axis ranges from 1:1 to 1:4.

4. The cover as claimed in claim 3, wherein said thickness of each of said stopping protrusions protruding from said outer sidewall ranges from 0.2 mm to 1.2 mm.

5. The cover as claimed in claim 1, wherein the number of said stopping protrusions ranges from 20 to 120.

6. The cover as claimed in claim 1, wherein said cover portion, said connecting portion, and said stopping protrusions are integrally formed as one piece from pulp.

7. The cover as claimed in claim 1, wherein said connecting portion further includes an inner sidewall surrounded by and radially spaced apart from said outer sidewall, and an abutment end wall connected between said inner side wall and said outer sidewall and having a position difference with said cover portion along the axis said inner side wall and said outer sidewall being configured to press against and clamp therebetween the mouth portion, and wherein said abutment end wall said inner sidewall and said outer sidewall cooperatively define an accommodating space for receiving the mouth portion, said accommodating space having an opening opposite to said abutment end wall.

8. The cover as claimed in claim 7, wherein said accommodating space has a width along a width direction transverse to the axis greater than a width of said abutment end wall along the width direction.

9. A container assembly comprising:

a plurality of containers, each of which includes a mouth portion surrounding an axis; and a plurality of said covers as claimed in claim 1, each of said covers being detachably connected to said mouth portion of a respective one of said containers and cooperating with said respective one of said containers to define a receiving space;

wherein said connecting portion of each of said covers further includes an inner sidewall surrounded by and radially spaced apart from said outer sidewall, and an abutment end wall connected between said inner sidewall and said outer sidewall and having a position difference with said cover portion along the axis, said inner sidewall and said outer sidewall of each of said covers being configured to press against and clamp therebetween said mouth portion of said respective one of said containers, and wherein said abutment end wall said inner sidewall and said outer sidewall of each of said covers cooperatively define an accommodating space for receiving said mouth portion of said respective one of said containers, said accommodating space having an opening opposite to said abutment end wall;

wherein said covers are stackable along the axis; and wherein, when said covers are stacked, said abutment end wall of one of said covers abuts against said stopping protrusions of an adjacent one of said covers, and said cover portion, said abutment end wall and said inner sidewall of each of said covers are respectively spaced apart from said cover portion, said abutment end wall and said inner sidewall of an adjacent one of said covers.

10. A container assembly, comprising:

a container including a mouth portion surrounding an axis; and said cover as claimed in claim 1, said cover being detachably connected to said mouth portion of said container, and cooperating with said container to define a receiving space.

11. The container assembly as claimed in claim 10, wherein:

said container further includes a bottom wall, and a surrounding wall extending upwardly from a periphery of said bottom wall along the axis and connected to said mouth portion;

said mouth portion includes an inner annular wall connected to an end of said surrounding wall that is opposite to said bottom wall, an outer annular wall radially spaced apart from said inner annular wall, and a top end wall interconnecting said inner annular wall and said outer annular wall and having a position difference with said bottom wall of said container along the axis;

said top end wall, said inner annular wall and said outer annular wall of said mouth portion cooperatively define an annular space having an opening opposite to said top end wall;

said outer sidewall of said cover surrounds said outer annular wall of said mouth portion, and together with said stopping protrusions presses against said outer annular wall of said mouth portion such that said outer annular wall of said mouth portion falls into said gaps formed between said adjacent stopping protrusions and is in frictional contact with said outer sidewall and said stopping protrusions of said cover, such that said inner sidewall of said cover presses against said inner annular wall of said mouth portion, and such that said abutment end wall of said cover presses against said top end wall of said mouth portion.

* * * * *